US010779658B1

(12) United States Patent
Antinori

(10) Patent No.: US 10,779,658 B1
(45) Date of Patent: Sep. 22, 2020

(54) MATTRESS TOP FOR INNERSPRING MATTRESS

(71) Applicant: Steve Antinori, Tampa, FL (US)

(72) Inventor: Steve Antinori, Tampa, FL (US)

(73) Assignee: PROTECH, LLC, Tampa, FL (US)

( * ) Notice: Subject to any disclaimer, the term of this patent is extended or adjusted under 35 U.S.C. 154(b) by 0 days.

(21) Appl. No.: 16/873,633

(22) Filed: May 25, 2020

Related U.S. Application Data

(63) Continuation-in-part of application No. 14/545,002, filed on Mar. 14, 2015, now abandoned.

(51) Int. Cl.

| | |
|---|---|
| ***A47C 27/06*** | (2006.01) |
| ***A47C 27/20*** | (2006.01) |
| *A47C 31/02* | (2006.01) |
| *A47C 23/04* | (2006.01) |

(52) U.S. Cl.
CPC ..... *A47C 27/064* (2013.01); *A47C 27/20* (2013.01); *A47C 23/04* (2013.01); *A47C 31/023* (2013.01)

(58) Field of Classification Search
CPC ..... A47C 23/04; A47C 23/043; A47C 23/05; A47C 23/14; A47C 23/20; A47C 27/04; A47C 27/045; A47C 27/0453; A47C 27/06; A47C 27/12; A47C 31/023
See application file for complete search history.

(56) References Cited

U.S. PATENT DOCUMENTS

| | | | | | |
|---|---|---|---|---|---|
| 854,161 | A * | 5/1907 | Hale | A47C 23/05 | 5/409 |
| 884,708 | A * | 4/1908 | Budd | A47C 23/05 | 5/409 |
| 1,291,773 | A * | 1/1919 | D'Arcy | A47C 23/05 | 5/409 |
| 1,323,370 | A * | 12/1919 | Madsen | A47C 21/022 | 24/457 |
| 1,336,525 | A * | 4/1920 | Lang | B60N 2/7041 | 5/409 |
| 1,781,086 | A * | 11/1930 | Smith | A47C 31/02 | 112/475.08 |
| 2,134,363 | A * | 10/1938 | Gleason | A47C 27/04 | 267/94 |
| 2,560,018 | A * | 7/1951 | Warner | A47C 27/053 | 5/248 |
| 2,587,112 | A * | 2/1952 | Caster | A47C 31/08 | 5/703 |
| 2,887,693 | A * | 5/1959 | Hodges, Jr. | A47C 27/04 | 5/721 |
| 2,975,437 | A * | 3/1961 | Freeman | A47C 27/04 | 5/716 |
| 3,950,800 | A * | 4/1976 | Garshfield | A47C 27/04 | 5/738 |
| 4,075,721 | A * | 2/1978 | Autrey | A47C 27/0453 | 5/716 |
| 5,210,890 | A * | 5/1993 | Hagglund | A47C 23/007 | 5/239 |

(Continued)

*Primary Examiner* — Robert G Santos
*Assistant Examiner* — Rahib T Zaman
(74) *Attorney, Agent, or Firm* — Arthur W. Fisher, III

(57) ABSTRACT

A mattress top for an innerspring mattress comprising an upper section including an outer decorative fabric layer and an inner foam layer and a lower section including an array of micro-springs to support the upper section wherein the periphery of the upper section and the periphery of the lower section are stitched together to form an unitary mattress top.

1 Claim, 10 Drawing Sheets

(56) References Cited

U.S. PATENT DOCUMENTS

| | | | | | |
|---|---|---|---|---|---|
| 5,435,026 | A * | 7/1995 | Cavazos | A47C 27/0453 | 24/706.1 |
| 5,461,737 | A * | 10/1995 | Ikeda | A47C 27/002 | 29/91.1 |
| 5,469,590 | A * | 11/1995 | Simon | A47C 27/04 | 267/287 |
| 6,370,717 | B1 * | 4/2002 | Kao | A47C 27/001 | 5/691 |
| 6,398,199 | B1 * | 6/2002 | Barber | A47C 27/064 | 267/93 |
| 6,574,815 | B2 * | 6/2003 | Freeman | A47C 27/002 | 5/690 |
| 6,883,196 | B2 * | 4/2005 | Barber | A47C 27/064 | 5/655.8 |
| 7,854,031 | B2 * | 12/2010 | Rawls-Meehan | A47C 7/027 | 5/719 |
| 7,917,980 | B2 * | 4/2011 | Kluft | A47C 23/30 | 5/716 |
| 2005/0034243 | A1 * | 2/2005 | Carlitz | A47C 31/007 | 5/716 |
| 2009/0193591 | A1 * | 8/2009 | DeMoss | A47C 23/0522 | 5/716 |
| 2010/0192299 | A1 * | 8/2010 | Schermel | A47C 27/053 | 5/421 |
| 2011/0302721 | A1 * | 12/2011 | Khambete | A47C 27/06 | 5/716 |
| 2012/0286460 | A1 * | 11/2012 | Tyree | A47C 27/064 | 267/91 |
| 2014/0283307 | A1 * | 9/2014 | Corodemus | A47C 27/002 | 5/691 |
| 2015/0026893 | A1 * | 1/2015 | Garrett | A47C 27/064 | 5/691 |

* cited by examiner

MATTRESS TOP FOR INNERSPRING MATTRESS

CROSS REFERENCE

This application is a continuation-in-part of Ser. No. 14/545,002 filed Mar. 15, 2015.

BACKGROUND OF THE INVENTION

Field of the Invention

A mattress top comprising an inner foam layer and an array of micro-springs integrally formed for use in the construction of an innerspring mattress.

Description of the Prior Art

Mattresses generally comprise three components: an innerspring support system, comfort layers and exterior fabric covering. Some mattresses may also include box springs. The innerspring support system is constructed from a series of wire coils or springs. There are four different types of springs used in mattresses: Bonnell, offset, continuous, and pocket system. Generally, the springs are attached to each other by wire. However, a pocket spring system comprises a plurality of small or micro-springs each disposed with a separate pocket formed by an upper and lower fabric. An insulator is secured directly to the innerspring such as inflexible wire mesh and foam. The insulator prevents the cushioning layer from molding to the springs. The cushioning layer is applied next and is comprised of different densities of foam, polyester and other natural fibers such as cotton pads. The number of cushioning layers applied depends on the quality of the mattress. The top comfort layer, called the quilt, may be constructed of light foam or fibers attached to the ticking. The ticking is the cover that is applied to the mattress. This and the quilted top layer of the mattress are sewn. This material is cut into the covering for the top, bottom and sides of the mattress and flanges are attached to the sides with fabric staples or to the innersprings by hog rings. These flanges are used to connect the mattress cover to the innersprings. Once this is done the mattress ticking is sewn together using border tape. This is fed through a specially designed machine that sews the material closed and gives the mattress its final finish.

Typical examples of the prior art are discussed below.

U.S. Pat. No. 6,964,074 discloses a sleep set and process of forming thereof comprises a mattress and box spring each having an allergen-impermeable barrier layer incorporated within. The mattress comprises a support apparatus, a top and bottom panel, first and second flanges, a border, a foam layer and a barrier layer. The border is positioned around the support apparatus and is attached to the top and bottom panels. The foam layer is positioned between the support apparatus and the top and bottom panels. The barrier layer comprises a material configured to be impermeable by allergens attached at its outer periphery to the interior facing sides of the top panel, the bottom panel and the border.

U.S. Pat. No. 7,917,980 relates to a mattress embodying a foam encasement surrounding individually wrapped coils. Border material is affixed to sidewalls forming the foam encasement and the upholstery layer is tacked to a base of the foam encasement.

U.S. Pat. No. 2,975,437 shows a pad wider than the wider frame the sisal pad. The over lapped end portion are joined together by the staples. The staples pass through the top part of the sisal pad and wire frame and the bottom part of sisal pad.

U.S. Pat. No. 6,944,900 discloses a mattress having an inverted top panel/border seam. An inverted seam secures the top panel to the border portion of a mattress cover to eliminate bumps and creases found in conventional welted top seam. Alternatively, a conventional tape edge machine can be used with reduced tape/welting material as all the stitches and welting are hidden inside the mattress by the inverted seam.

U.S. Pat. No. 5,586,511 shows an improved method and apparatus for the assembly of pillow-top mattress covers. The gussets for a pillow-top mattress cover are prepared in a single step in which the gusset material is folded longitudinally, and the flange material is attached thereto and the gusset material is sewn together in one stitch. Thereafter, a gusset is attached to each of the top and bottom panels of the cover along its outer edge. Each gusset is secured to the underside of its associated top or bottom panel at the folded edge using a blind stitch which is not visible externally of the panel. No gluing is required. During the step of attaching the gusset to its associated mattress cover panel, precisely positioned mitered corners are formed on the gusset where the gusset is to be attached to the corner of its associated panel. A conventional blind stitch machine is modified to accept thicker work by providing a wider cam for urging work into the needle area, top and bottom feed rollers disposed even with the needle, and pneumatic control of the lower support arm.

U.S. Pat. No. 6,574,815 relates to an attachment gusset with ruffled corners and method and machinery for manufacture provides a gusset formed of a continuous strip of material which is pleated at corners or turns in direction of the gusset to form ruffles which are attached to an adjacent layer of material. The ruffled gusset lies substantially flat against adjacent layers of material to which it is attached in a pressed state, and can be expanded to accommodate dimensional structures, such as cushioned pads. The number and spacing of pleats can be adjusted according to the radius of the corners or turns in the gusset. In a method of construction of the gusset, the pleats are formed as the material to which the gusset is attached is turned relative to the sewing point of attachment.

U.S. Pat. No. 2,399,628 shows a rubber pad from one to two inches in thickness and both wider and longer than the spring unit so that when assembled with the spring unit overhanging the marginal wires on all sides by about one inch. The pad is protected by a cloth casing to which it should be secured immovably without interference with flexing of the pad and to this end a heavy cotton duck or other porous cloth sheet is stretched over the top of the pad while a similar or even heavier fabric sheet is stretched over the bottom of the pad with both sheets being stitched to together.

U.S. Pat. No. 2,587,112 relates to a covering pad of sisal extending over the upper ends of the springs. This pad is folded at its longitudinal edges to extend about the top rectangular spring frame to which the upper ends of the springs are connected. The rectangular frame extends about the periphery frame of the spring structure and acts as a means of connecting the various springs and holding them in proper relation. The edge of the sisal pad is wrapped about the frame member to provide a folded edge underlying a portion of the sisal pad inwardly of the spring frame. Staples or other suitable fastening means extend through the body of the pad to hold the edge folded about the spring frame.

U.S. Pat. No. 4,075,721 discloses a mattress construction and method in which an extremely wide, deep stitch flange permits a more uniform and tighter mattress construction. A mattress cover is sewn to an apron or flanging material with a wide border or flange with the thread being deeply set in the cover by the thick foam padding between the flange material and the cover. This construction allows the apron to be very tightly pulled over a coil spring and stapled through sisal padding to the coil spring rim or border. The stretching of the flange skirt and cover creates a bow in the coil spring pulling the rim toward the center. The wide flange then permits the skirt or side cover to be tightly stitched with edging tape or binding material to produce a very firm and flat mattress construction.

U.S. Pat. No. 5,461,737 shows a pad arranged on the upper and lower sides of a spring unit to provide a laminate structure. The laminate structure is covered with an outer cover body comprising top and bottom layers covering the corresponding pads and a side layer covering the laminate structure. A joining member of heat-shrinkable synthetic resin has one end width portion joined to the inner surfaces of the whole marginal edge portions of the top and bottom layers. The other end width portion of the joining member covers the corresponding outer marginal edge portions of the pads. The joining member, upon being heat shrunk, have another end width portion brought into firm engagement with the spring unit so that the pads and outer cover body are firmly held relative to the spring unit.

Additional examples of the prior art are found in the following documents: U.S. Pat. Nos. 7,412,036; 6,874,214; 3,068,495; 2,887,693; 2,627,902; 2,621,713; 2,615,504; 2,560,018; 2,359,047; 2,134,363; 1,781,086; 1,557,483; 1,336,525; 1,323,370; 1,291,773; 0,884,708; 0,854,161 and 4,476,595.

While some of the prior art may contain some similarities relating to the present invention, none of them teach, suggest or include all of the advantages and unique features of the invention disclosed hereafter.

SUMMARY OF THE INVENTION

The present invention relates to a mattress top for an innerspring mattress including an innerspring system consisting of a plurality of coil springs and a cushioning system consisting of a plurality of resilient layers of foam.

The mattress top comprises an upper cushioning section and a lower micro-spring support section.

The upper cushioning section comprises an outer layer of decorative upholstery fabric and an inner layer of resilient cushioning material.

The lower micro-spring support section comprises an array of micro-springs disposed within corresponding pockets arranged in substantially equally spaced rows and columns. A peripheral margin is formed at the edge of the lower micro-spring support section.

The various components of the mattress top are assembled into an integrated unit by aligning the components in overlaying relationship relative to each other. Once properly positioned, the outer layer of decorative upholstery fabric in the inner layer of resilient cushioning material and the lower micro-spring support section are stitched or surged around the peripheral edges or margins. The peripheral margin formed at the edge of the lower micro-spring support permits the stitching without obstruction from the outermost micro-springs of the lower micro-spring support section.

The invention accordingly comprises the features of construction, combination of elements, and arrangement of parts which will be exemplified in the construction hereinafter set forth, and the scope of the invention will be indicated in the claims.

BRIEF DESCRIPTION OF THE DRAWINGS

For a fuller understanding of the nature and object of the invention, reference should be had to the following detailed description taken in connection with the accompanying drawings in which.

Similar reference characters refer to similar parts throughout the several views of the drawings.

DETAILED DESCRIPTION OF THE INVENTION

Figure 1:
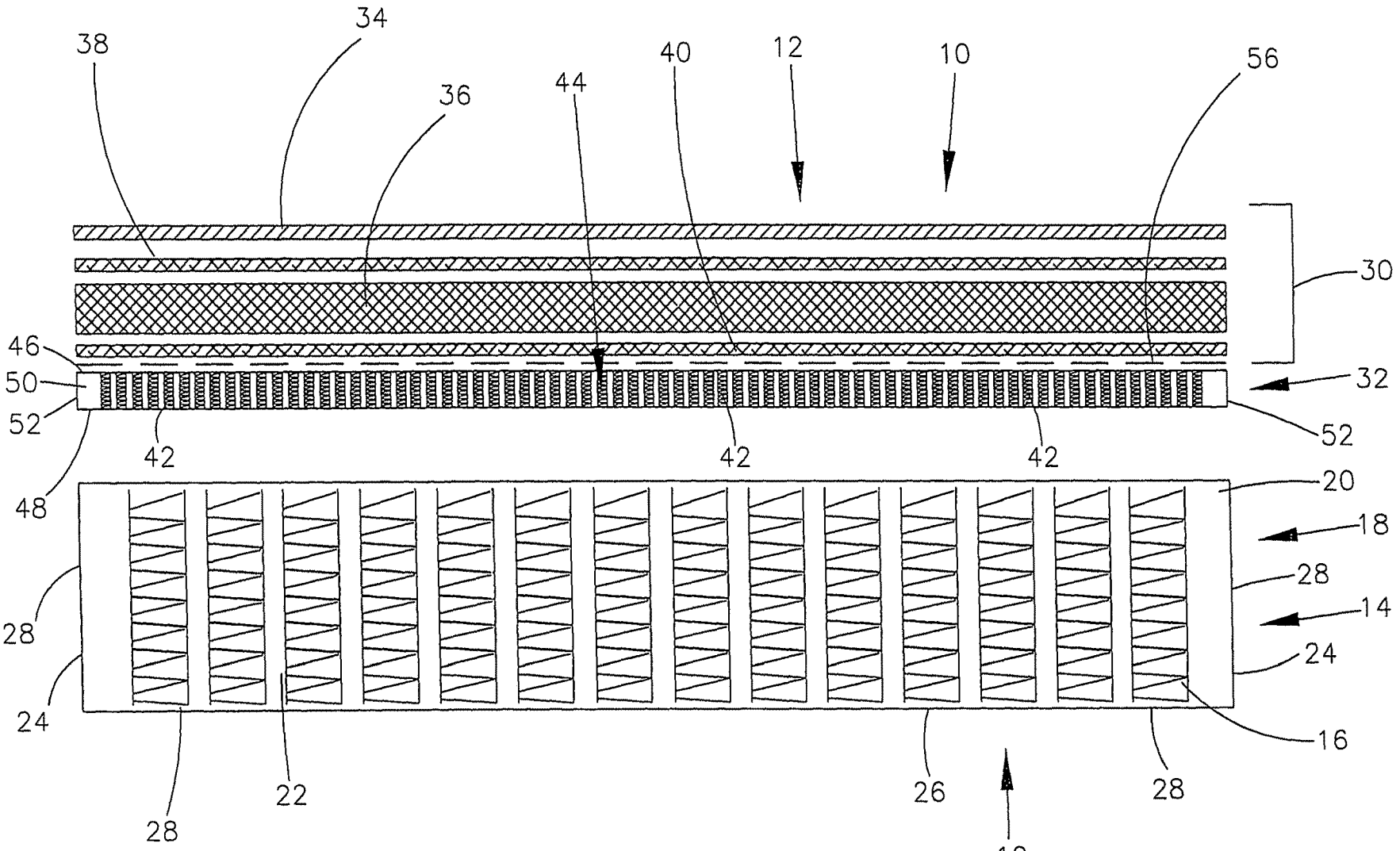
FIG. 1 is an exploded side view of the mattress top of the present invention.
Figure 2:
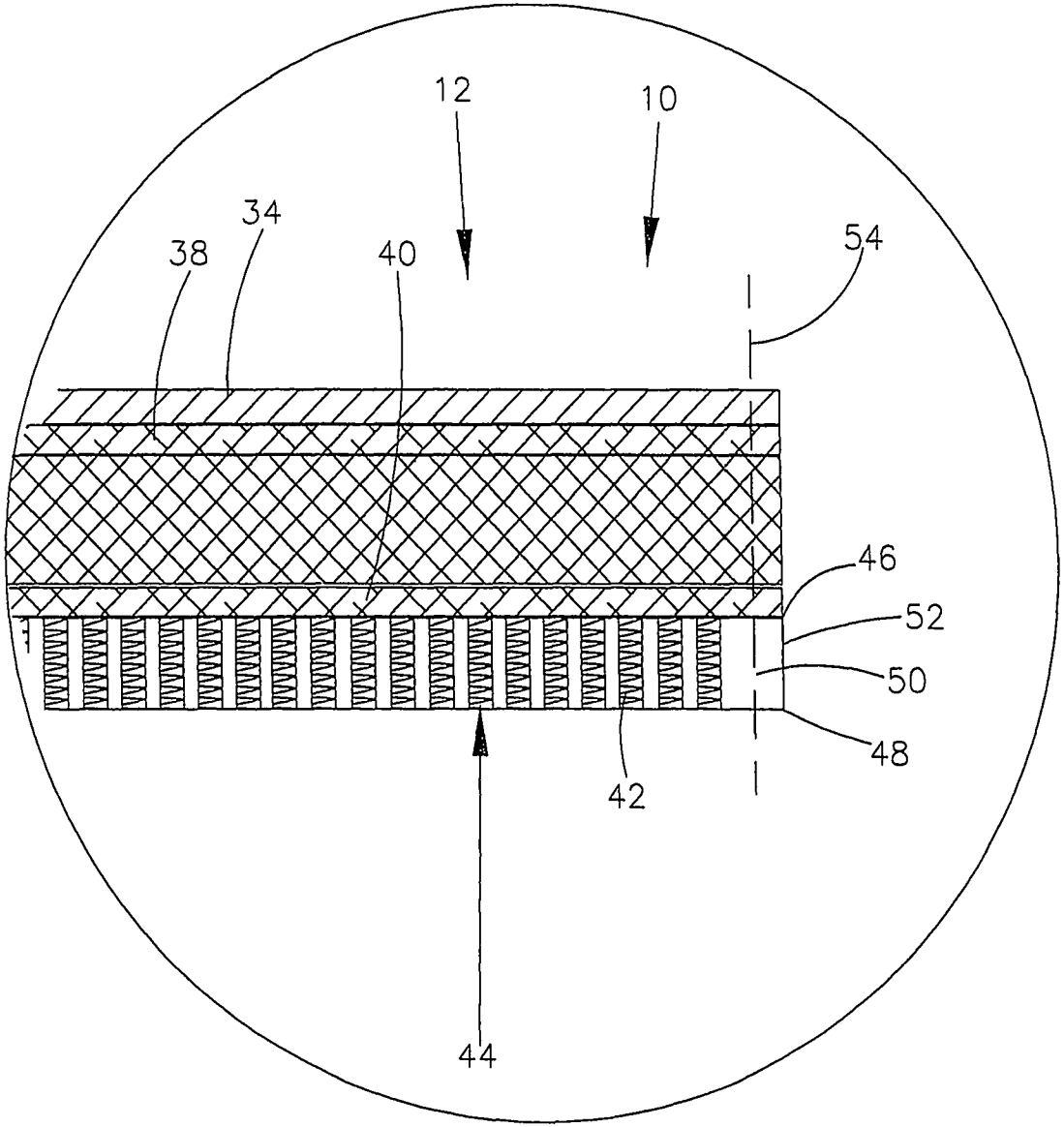
FIG. 2 is a partial side view of the mattress top of the present invention assembled.

As shown in FIGS. 1 and 2, the present invention relates to a mattress top generally indicated as 10 for an innerspring mattress generally indicated as 12 including an innerspring system generally indicated as 14 consisting of a plurality of coil springs each indicated as 16 and a cushioning system generally indicated as 18 consisting of a plurality of resilient layers of foam each indicated as 20. The sides 22 and ends 24 and the bottom of the innerspring mattress 12 are encased or enclosed by a fabric border 28 extending about the periphery thereof.

As shown in FIGS. 1 and 2, the mattress top 10 comprises an upper cushioning section generally indicated as 30 and a lower micro-spring support section generally indicated as 32.

As shown in FIGS. 1 and 2, the upper cushioning section 30 comprises an outer layer of decorative upholstery fabric 34 and an inner layer of resilient cushioning material 36 such as foam separated by a layer of fire retardant material 38. A layer of backing material 40 may be disposed between the inner layer of resilient cushioning material 36 of the upper cushioning section 30 and the lower micro-spring support section 32.

Figure 3:
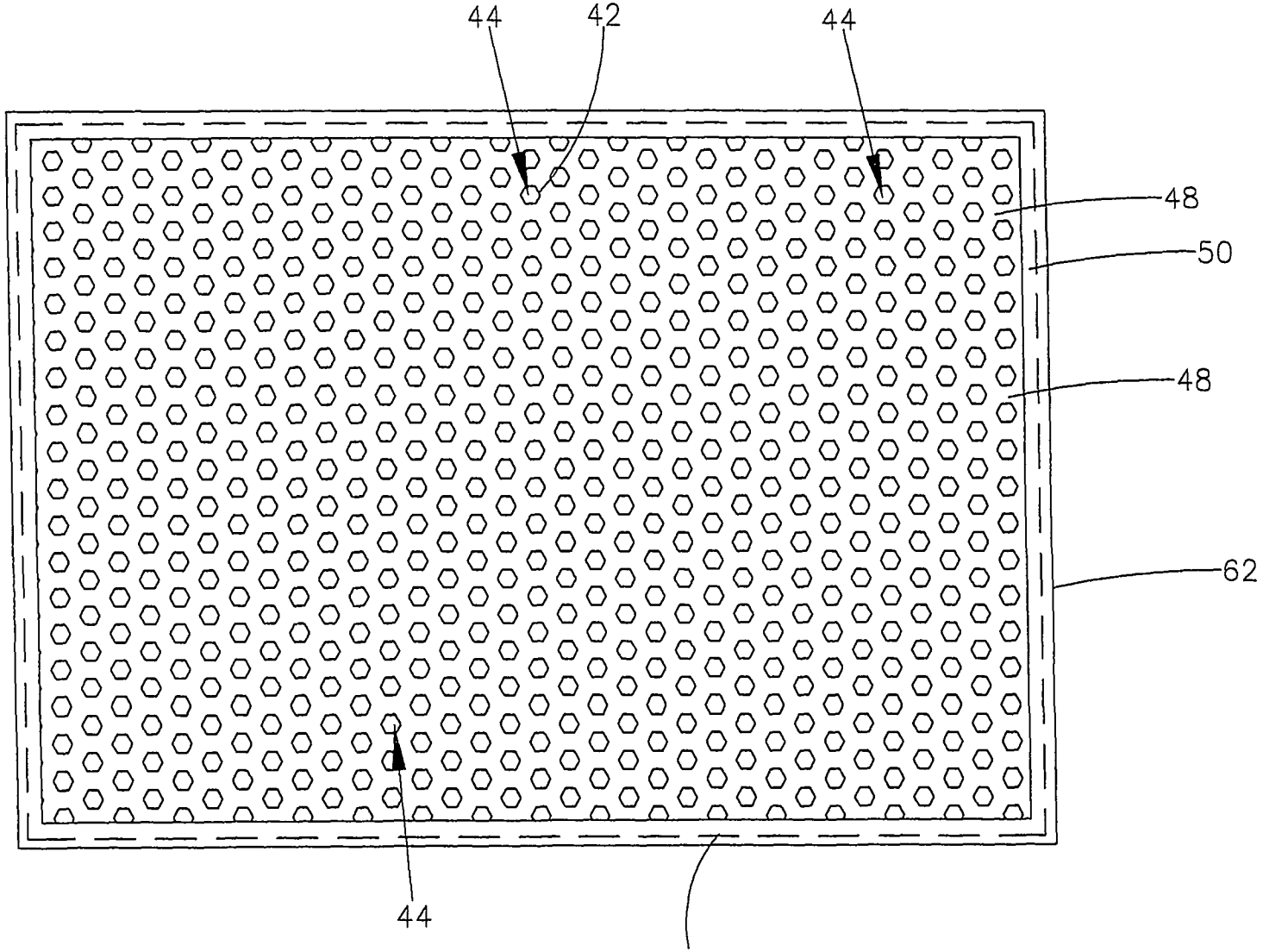
FIG. 3 is a bottom view of the mattress top of the present invention.

As shown in FIGS. 1 through 3, the lower micro-spring support section 32 comprises an array of micro-springs each micro-spring indicated as 42 disposed within a corresponding pocket each indicated as 44 disposed between an upper layer of gauze-like fabric 46 and a lower of gauze-like fabric 48 arranged in substantially equally spaced rows and columns. The outer most rows and columns of micro-springs 42 disposed within the corresponding pocket 44 of the lower micro-spring support section 32 are spaced inwardly from the sides and ends of the upper layer of gauze-like fabric 46 and a lower of gauze-like fabric 48 to form a peripheral margin 50 at the edges 52 of the upper layer or sheet of gauze-like fabric 46 and the lower layer or sheet of gauze-like fabric 48.

Assembly of the various components of the mattress top 10 into an integrated unit is best understood with reference to FIG. 2. Specifically, the components of upper cushioning section 30 and the lower micro-spring support section 32 are aligned in overlaying relationship relative to each other as depicted. Once properly positioned, the outer layer of decorative upholstery fabric 34, the inner layer of resilient cushioning material 36 and the lower micro-spring support section 32 are stitched or surged together as 54 around the peripheral edges or margins. The peripheral margin 50 formed at the edges 52 of the upper layer of gauze-like fabric 46 and lower layer of gauze-like fabric 48 permit the stitching 54 allowing movement of adjacent pocket springs 42 of the lower micro-spring support section 42 without obstruction from the outermost micro-springs 42 disposed about the outer periphery of the lower micro-spring support section 32.

Rigid or solid encasements typically comprising spring supports restrict or prevent the flow of air through the spring supports. Among other benefits of not requiring a rigid or solid encasement around the pocket springs 42 air is able to circulate through the pocket springs 42. as in the instant invention.

The layer of fire-retardant material 38 may be placed between the outer layer of decorative upholstery fabric 34 and the inner layer of resilient cushioning material 36 assembly before stitching. In addition, the layer of backing material 40 may be placed between the inner layer of resilient cushioning material 36 and the lower micro-spring support section 32 during assembly and glued as at 56 before stitching.

Figure 4:
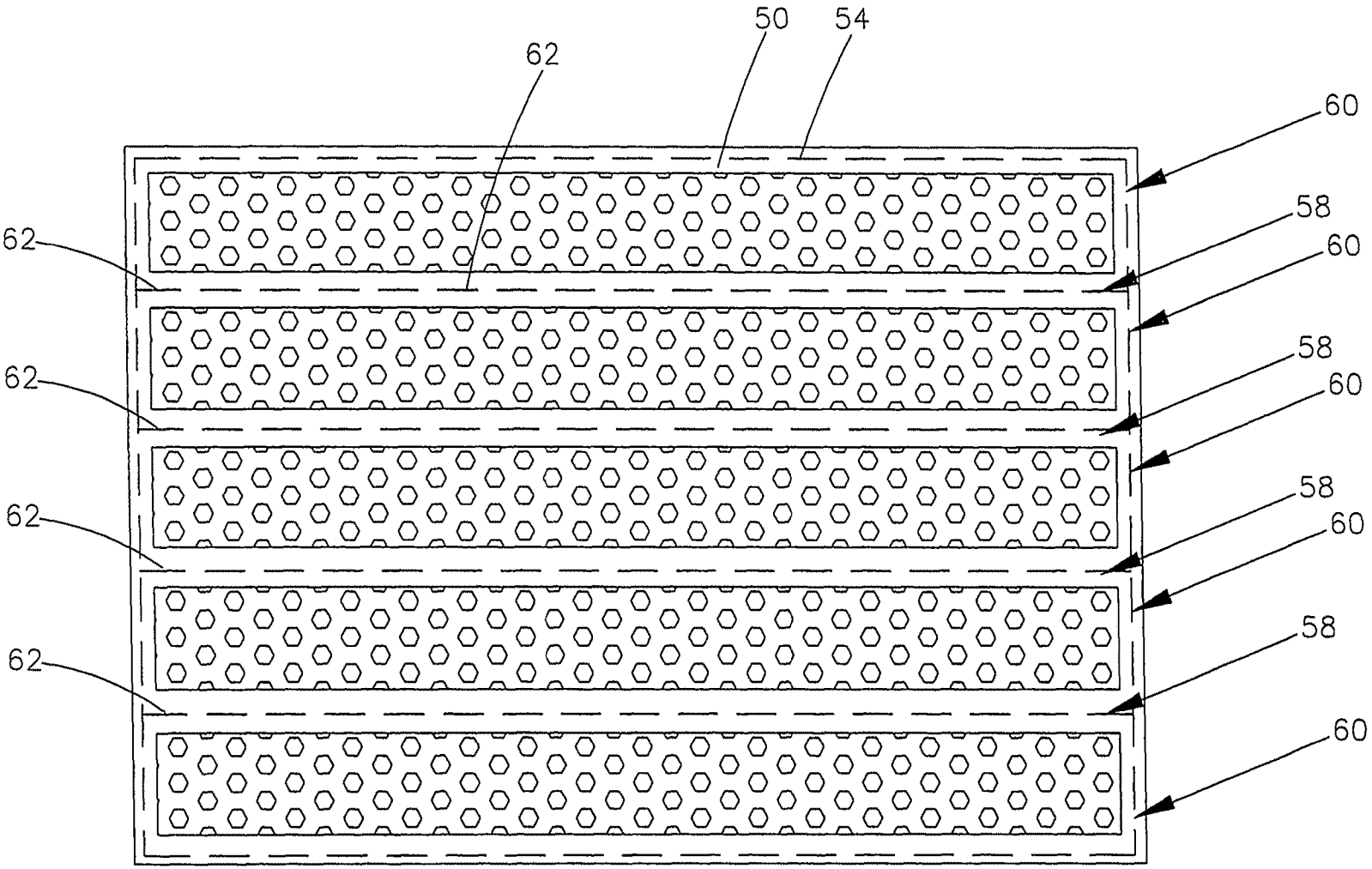
FIG. 4 is a bottom view of an alternate embodiment of lower micro-spring support section of the mattress top of the present invention.

FIG. 4 shows an alternate array of micro-springs 42 are arranged into a plurality of rows forming a plurality of sections each indicated as 60 separated by space each indicated as 58. This permits the upper layer of gauze-like fabric 46 and a lower layer of gauze-like fabric 48 to be stitched along the spaces 58 as at 62.

Figure 5:
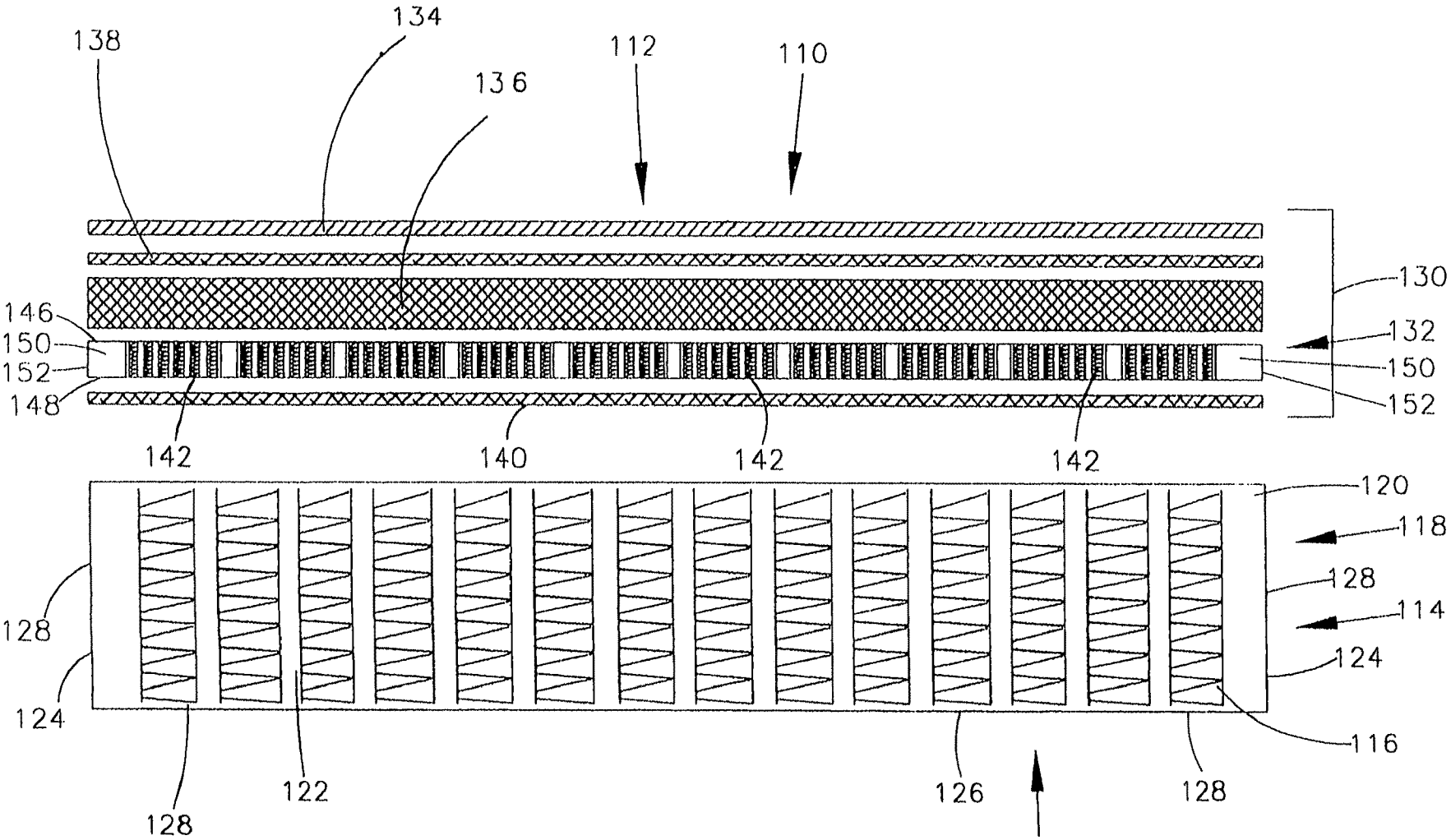
FIG. 5 is an exploded side view of an alternate embodiment of the mattress top of the present invention.
Figure 6:
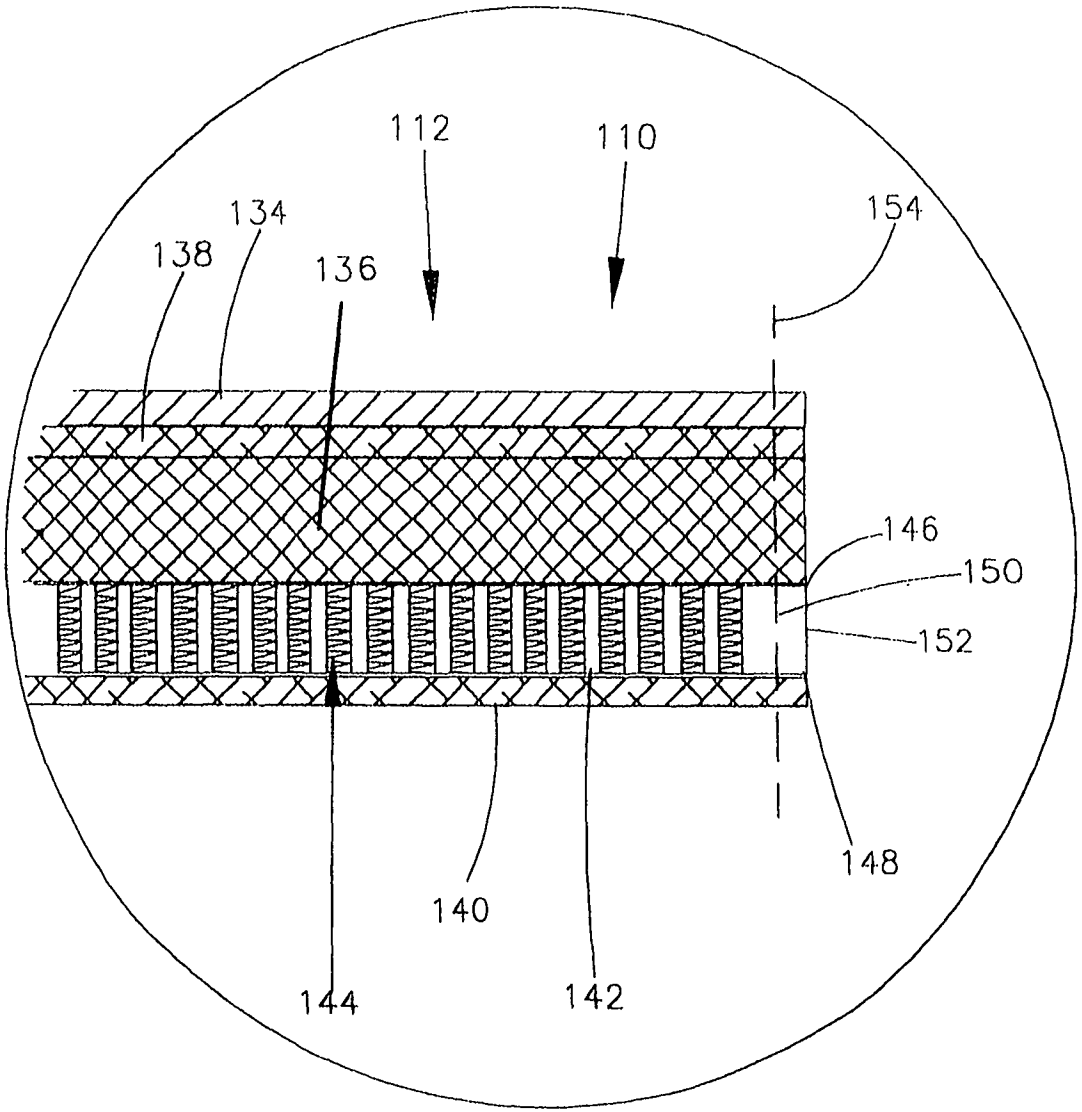
FIG. 6 is a partial side view of the alternate embodiment of the mattress top of the present invention shown in FIG. 3 assembled.

FIGS. 5 and 6 show an alternate embodiment of the generally indicated as 110 for an innerspring mattress generally indicated as 112 including an innerspring system generally indicated as 114 consisting of a plurality of coil springs each indicated as 116 and a cushioning system generally indicated as 118 consisting of a plurality of resilient layers of foam each indicated as 120. The sides 122 and ends 124 and the bottom 126 of the innerspring mattress 112 are encased or enclosed by a fabric border 128 extending about the periphery thereof.

As shown in FIGS. 5 and 6, the mattress top 110 comprises an upper cushioning section generally indicated as 130 and a lower micro-spring support section generally indicated as 132.

As shown in FIGS. 5 and 6, the upper cushioning section 130 comprises an outer layer of decorative upholstery fabric 134 and an inner layer of resilient cushioning material 136 such as foam separated by a layer of fire retardant material 138. A layer of backing material 140 may be disposed between the lower micro-spring support section 132 and the innerspring mattress 114.

As shown in FIGS. 5 and 6, the lower micro-spring support section 132 comprises an array of micro-springs each indicated as 142 disposed within corresponding pockets each indicated as 144 formed between an upper level of gauze-like fabric 146 and a lower layer of gauze-like fabric 148 arranged in substantially equally spaced rows and columns. A peripheral margin 150 is formed at the edges 152 of the upper layer or sheet of gauze-like fabric 146 and the lower layer or sheet of gauze-like fabric 148 of lower micro-spring support section 132.

Assembly of the various components of the mattress top 110 into an integrated unit is best understood with reference to FIG. 6. Specifically, the components of upper cushioning section 130 and the lower micro-spring support section 132 are aligned in overlaying relationship relative to each other as depicted. Once properly positioned, the outer layer of decorative upholstery fabric 134, the inner layer of resilient cushioning material 136 and the lower micro-spring support section 132 are stitched or surged together at 154 around the peripheral edges or margins. The peripheral margin 150 formed at the edges 152 of the upper layer of gauze-like fabric 146 and lower layer of gauze-like fabric 148 permit the stitching 154 without obstruction from the outermost micro-springs 142 disposed about the outer periphery of the lower micro-spring support section 132.

The layer of fire retardant material 138 may be placed between the outer layer of decorative upholstery fabric 134 and the inner layer of resilient cushioning material 136 assembly before stitching. In addition, the layer of backing material 140 may be glued to the lower micro-spring support section 132 during assembly.

The mattress top 10/110 is attached or secured to the innerspring mattress 12/112 by a flanging process.

For example, the lower micro-spring support 32/132 of the mattress top 10/110 may be glued to the cushioning system 18/118 of the innerspring system 14/114.

Alternatively, a flange of fabric may be used to attach or secure the mattress top 10/110 to the innerspring mattress 12/112. Specifically, a fabric flange extension 164 may extend outwardly from the periphery of the outer decorative upholstery fabric 34 or 134 respectively of the upper cushioning section 30 and 130 respectively. The outer portion 66 or 166 is tacked or stapled to the fabric border 28 or 128 respectively of the innerspring mattress 12/112 of the innerspring system 14/114.

Figure 7:
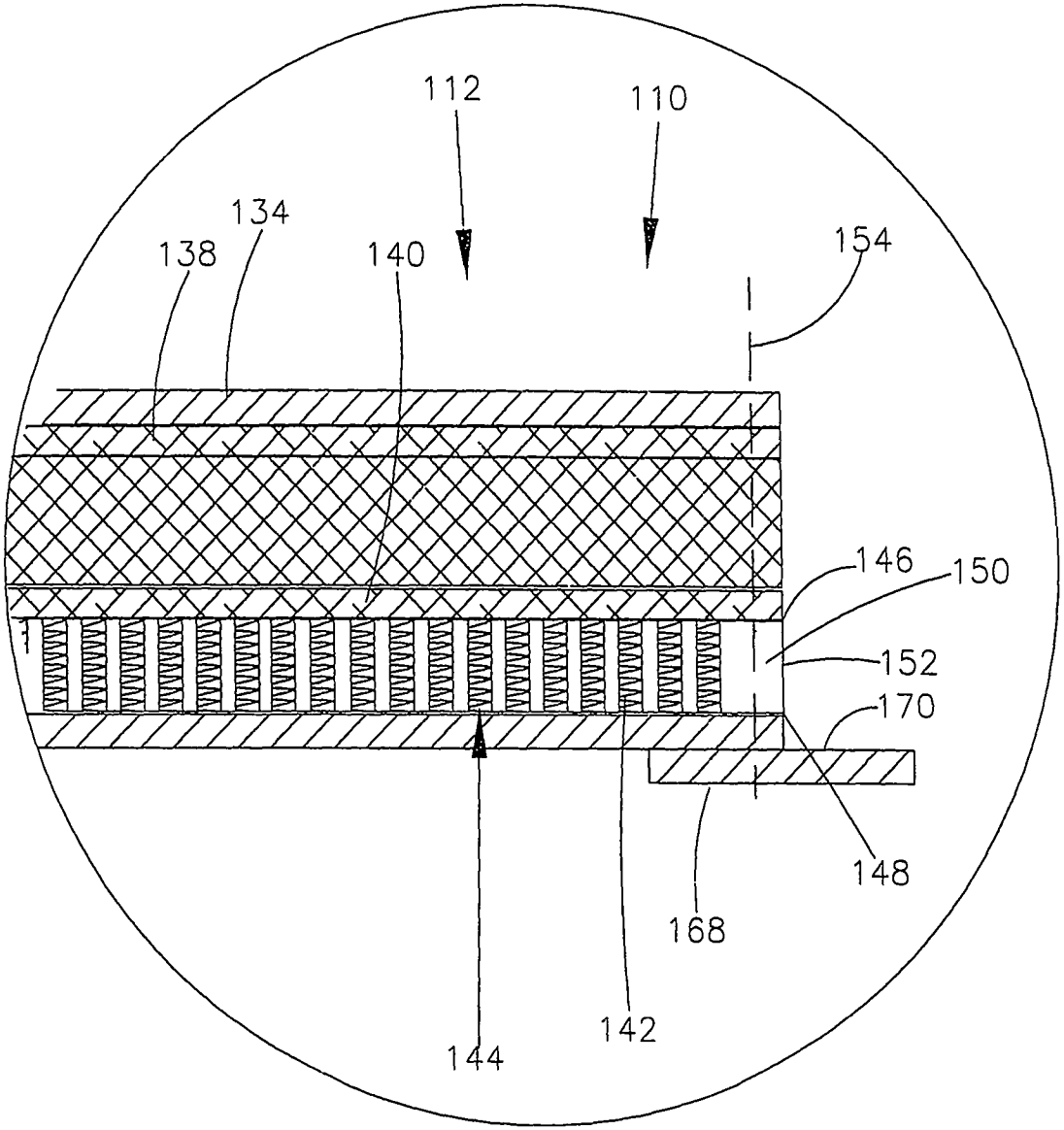
FIG. 7 is a partial side view of the attachment flange of the mattress top of the present invention.

FIG. 7 shows a fabric flange 168 stitched to the lower layer of gauze-like fabric 148 of the lower micro-spring support section 132 of the mattress top 10 during assembly of the mattress top 110. The outer portion 170 of the fabric flange 168 is secured to the innerspring mattress 112 by stitching, stapling or gluing.

Figure 8:
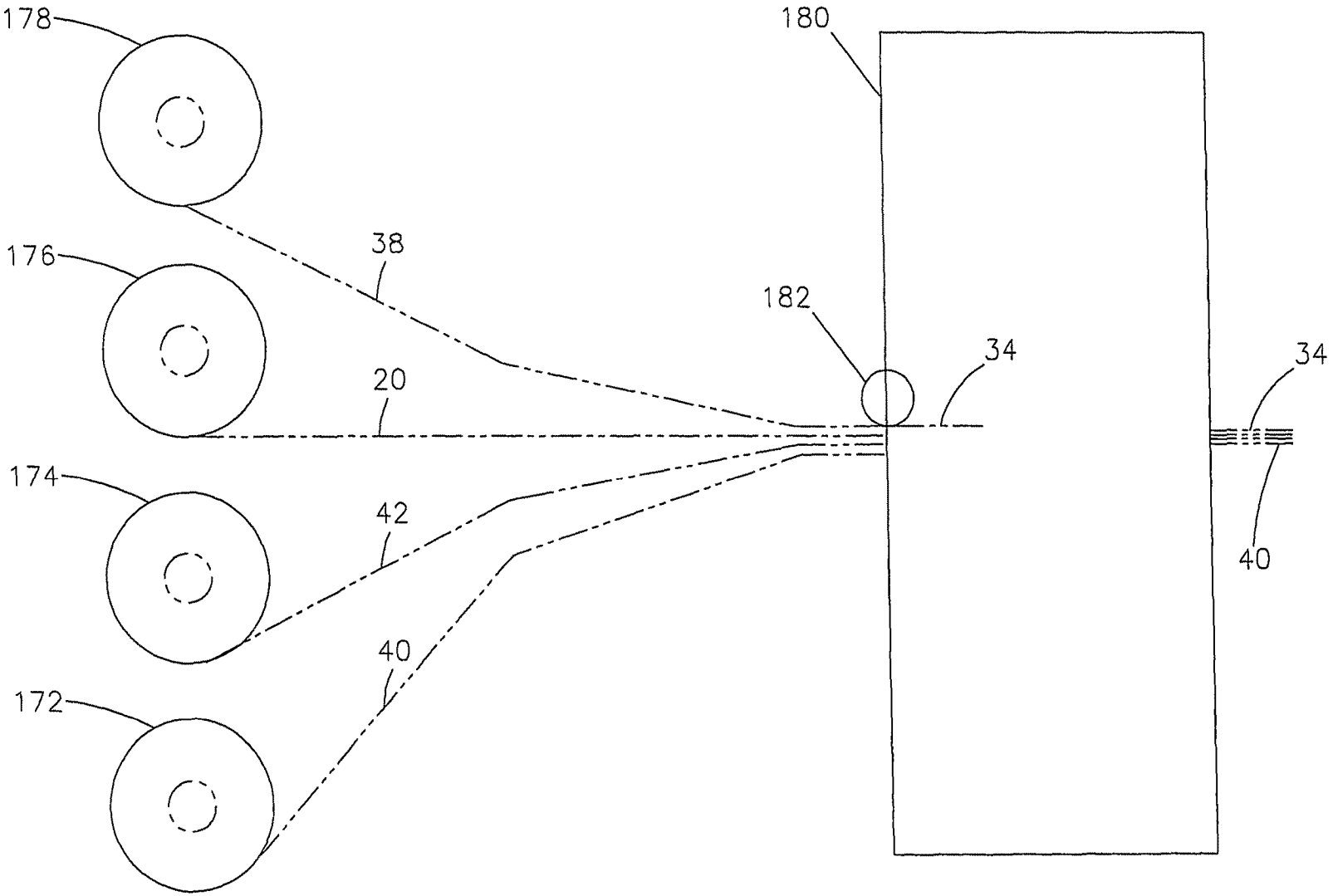
FIG. 8 is a schematic side view of a quilting machine and rolls of material to be integrated into the mattress top cover of the present invention.

FIG. 8 depicts an alternative embodiment of the mattress top 10 of the present invention. Specifically, the micro-spring support section 32 is integrated or sewn into the mattress top 10 during the quilting process.

Figure 9:
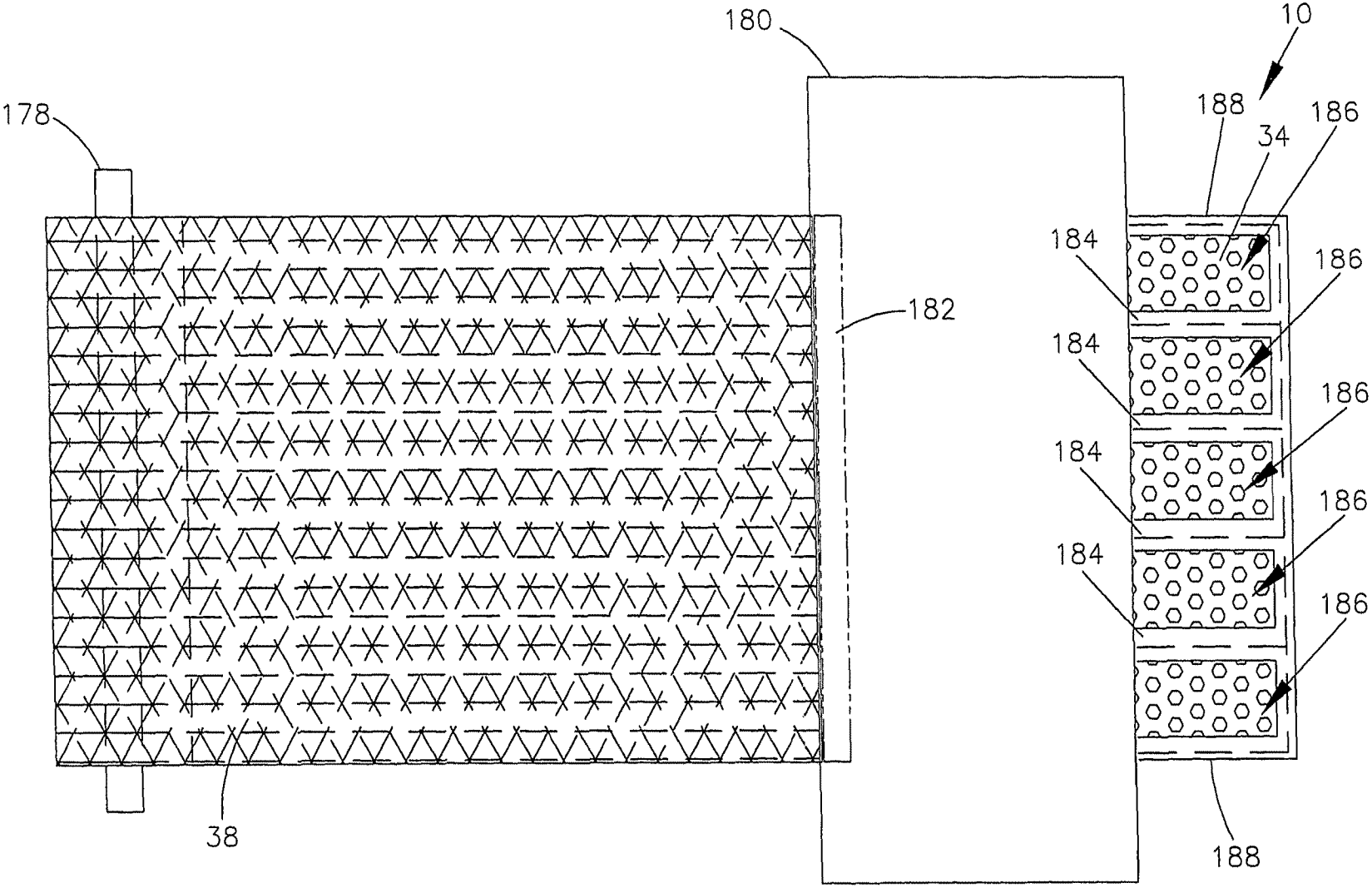
FIG. 9 is a top view of a quilting machine and rolls of materials to be integrated into the mattress top of the present invention.
Figure 10:
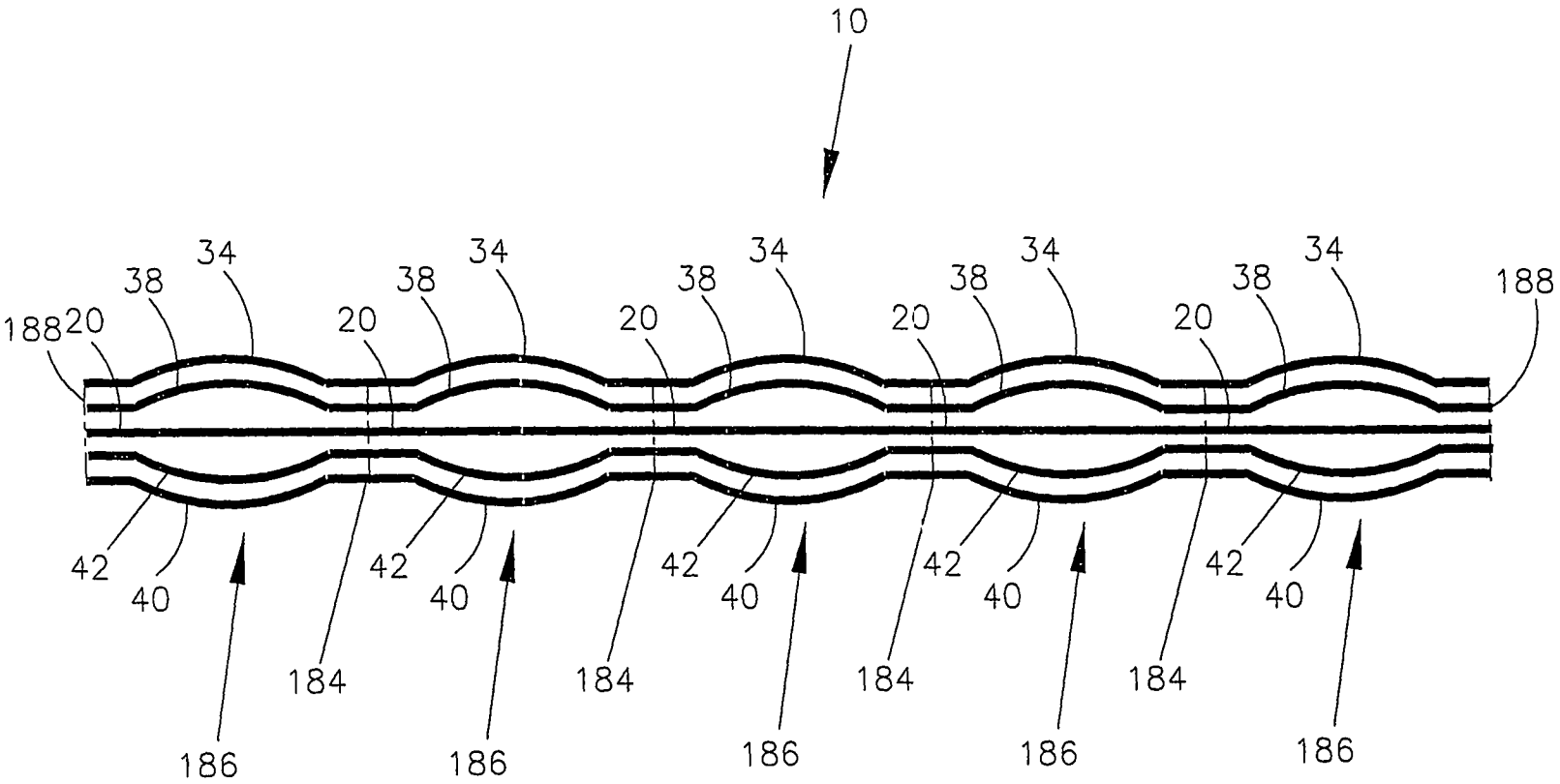
FIG. 10 is an end view of FIG. 4 with the materials sewn together by the quilting machine before the peripheral edges are sewn or surged together.

As shown in FIGS. 9 and 10, rolls of backing material 40, micro-springs 42 disposed between the upper and lower layers of fabric previously identified as 46 and 48 respectively, resilient foam 20 and fire retardant material 38 indicated as 172, 174, 176 and 178 respectively are operatively aligned with a quilting machine 180 to supply these components to the quilting machine 180 to be sewn or quilted together with the outer layer of decorative upholstery fabric 34 fed from a roll 182 or similar supply base.

As shown in FIGS. 8 and 10, the mattress top 10 is sewn or stitched 184 into longitudinally disposed panels each generally indicated as 186 such that the micro-springs 42 are sewn into the interior of the mattress top 10 before the outer periphery or margin 188 of the mattress is sewn or serged.

It will thus be seen that the objects set forth above, among those made apparent from the preceding description are efficiently attained and since certain changes may be made in the above construction without departing from the scope of the invention, it is intended that all matter contained in the above description or shown in the accompanying drawing shall be interpreted as illustrative and not in a limiting sense.

It is also to be understood that the following claims are intended to cover all of the generic and specific features of the invention herein described, and all statements of the scope of the invention which, as a matter of language, might be said to fall therebetween.

Now that the invention has been described,

What is claimed is:

1. A mattress top for use in combination with a lower innerspring system, said mattress top comprising: upper cushioning section and a lower micro-spring support section, said lower micro-spring support section including an array of pocket micro-springs arranged in a plurality of rows having an outer periphery, each said row of pocket micro-springs disposed in independent relationship relative to said adjacent row of pocket micro-springs, said upper cushioning section comprising an outer layer of fabric and an inner layer of resilient cushioning material including an outer periphery and disposed in co-planar relationship with said pocket micro-springs, said pocket micro-springs being disposed between said inner layer of resilient cushioning material and a lower layer of fabric wherein said pocket micro-springs being disposed inwardly from said outer periphery of said lower micro-spring support section to form a peripheral margin around said array of pocket micro-springs, said outer periphery of said inner layer of resilient cushioning material and said peripheral margin of said lower micro-spring support section are stitched together about the periphery of said mattress top without a confining or rigid encasement such that said rows of adjacent pocket micro-springs are not constrained allowing limited movement of said upper cushioning section relative to said lower micro-spring support section and between adjacent rows of said pocket springs in response to movement of a person positioned said mattress top.

* * * * *